US007046768B1

(12) United States Patent
Gilevich

(10) Patent No.: US 7,046,768 B1
(45) Date of Patent: May 16, 2006

(54) SHUTTER-SHIELD FOR X-RAY PROTECTION

(75) Inventor: Alexander I. Gilevich, Sunnyvale, CA (US)

(73) Assignee: InspX LLC, Fremont, CA (US)

( * ) Notice: Subject to any disclaimer, the term of this patent is extended or adjusted under 35 U.S.C. 154(b) by 190 days.

(21) Appl. No.: 10/706,013

(22) Filed: Nov. 10, 2003

(51) Int. Cl.
*G21K 1/04* (2006.01)

(52) U.S. Cl. ..... 378/160; 378/147; 250/505.1

(58) Field of Classification Search ..... 378/160, 378/147, 145, 150, 141; 250/505.1
See application file for complete search history.

(56) References Cited

U.S. PATENT DOCUMENTS 4,195,229 A * 3/1980 Suzuki ..... 378/16
4,366,576 A * 12/1982 Annis ..... 378/146
5,172,402 A * 12/1992 Mizusawa et al. ..... 378/34

* cited by examiner

*Primary Examiner*—Edward J. Glick
*Assistant Examiner*—Elizabeth Keaney
(74) *Attorney, Agent, or Firm*—J. E. McTaggart

(57) ABSTRACT

A shutter-shield system for radiation protection is applied to a an x-ray generator in a shielded station for inspecting products moving through the station on a conveyor. Deployed in a sliding attachment on a collimator housing of the x-ray generator, a shutter plate is made movable by an actuator and is configured with an aperture that, in the absence of power applied to the actuator, is made to align with a fixed aperture of the collimator so as to allow emission of the x-ray beam as required for normal inspection purposes. Whenever an anomaly in the product loading on the conveyer creates a gap that could otherwise cause an increase in environmental radiation levels, powering the actuator moves the shutter plate to an offset location that offsets the apertures to an effectively closed state to initiate a standby condition wherein x-ray radiation is substantially confined to the interior region of the collimator, without having to shut down the x-ray generator itself.

4 Claims, 1 Drawing Sheet

SHUTTER-SHIELD FOR X-RAY PROTECTION

FIELD OF THE INVENTION

The present invention relates to the field of x-ray generators and more particularly to a shutter-shield system for enhancing the shielding and protection of personnel against stray X-ray radiation in the vicinity of an X-ray product inspection station in a manufacturing environment.

BACKGROUND OF THE INVENTION

In addition to their well-known use for medical examination, X-rays have found increasing use for inspection purposes in manufacturing, e.g. for inspecting food products in containers for impurities that can be detected as having higher density than the substance under test and thus greater attenuation of applied X-rays. In a typical food product inspection station, a shielded head-end unit including an x-ray source and an x-ray sensor scans containers of food or beverages as they are moved sequentially through the head-end unit at a rate that can typically range up to 1000 containers per minute. While the containers are typically closely adjacent, there may be unpredictable periods of time during which the flow of product on a conveyor is interrupted, causing random gaps of substantial distance between adjacent containers.

Typically the x-ray source, sensor and conveyor driving mechanism are controlled from a control console which is located nearby in a separate enclosure and which may include a microprocessor along with electronic control and logic circuitry for implementing the inspection program.

Despite efforts to collimate the x-rays from the generator, i.e. direct them in parallel straight lines, confined to the product item under test and the sensor, the X-rays tend to diffuse and scatter whenever they collide with matter, and to thus escape through any openings in the shield structure; therefore, in the work environment, tight shielding is required to protect workers from harmful cumulative effects of exposure to extraneous x-ray radiation.

In the field of endeavor of the present invention where the product item is typically packaged food and beverage items such as bottled liquids moving along a conveyor, it is customary to surround the generator, product item under test, sensor and the associated portion of the conveyor with an enclosure constructed from high density X-ray shielding material; typically material of ultra high molecular weight is utilized to avoid excessive thickness requirements.

Of particular concern are the entry and exit openings that are required for product to flow through the test station: x-ray leakage through such openings may be minimized by providing shield tunnels and/or shield doors, however their shielding effectiveness depends somewhat on full loading and uniform close spacing of product containers within the test station to minimize radiation leakage as the containers move through on the conveyor. A gap in the loading of product moving along the conveyor could result in increased radiation leakage during the corresponding time period as the gap enters and/or exits the test station.

Since the health hazard effects of X-ray exposure are cumulative, the degree of risk is proportional to the product of exposure time duration and the level of radiation, so it is important to maximize the margin of safety by minimizing both the time duration and the level of the environmental radiation, and to take special measures to avoid even short periods of increased radiation levels.

DISCUSSION OF KNOWN ART

X-ray generators of known art commonly utilized for inspection purposes generally require a preliminary warmup time in the order of several minutes to recover to normal after being turned off. Furthermore, the life expectancy of the X-ray tube may be seriously impaired by frequently repeated on/off switching, so it is customary to run the X-ray generator continuously, even for periods of time when it is not required for testing.

The level of x-ray radiation leakage that occurs during such standby periods is of particular concern with regard to overall environmental x-ray protection of personnel, especially if these periods tend to be lengthy and/or if the environmental radiation level tends to increase significantly in the absence of product in the inspection chamber, U.S. Pat. No. 6,400,795 to Yagi discloses an X-RAY FLUORESCENCE ANALYZER having an x-ray generator and a sensor enclosed in a common shielded enclosure configured with a large aperture providing passageway for both (a) outgoing radiation directed to an externally-located subject being analyzed for fluorescence and (b) reflected radiation returning into the sensor. An exposure-timing shutter opens and closes the aperture for each exposure event. Related U.S. Pat. No. 6,359,962 shows similar structure without a shielding outline.

OBJECTS OF THE INVENTION

It is a primary object of the present invention, in the production work environment of a test station for X-ray inspection of products in containers moving along a conveyor, to provide improved worker protection against potential harmful cumulative effects of X-ray exposure through enhanced overall containment and suppression of potentially harmful effects of X-ray radiation in the environment around the outside of the test station.

More particularly it is an object to minimize any increase x-ray radiation leakage from an x-ray food product inspection test station through entry and exit openings thereof related to the absence or non-uniformity of food containers under inspection.

It is a further object to provide implementations of the invention that can be retrofitted onto existing x-ray sources such as those used in food product inspection stations, to enhance worker protection in the testing environment.

SUMMARY OF THE INVENTION

The abovementioned objects have been met by the present invention of a shutter-shield system applied to a an x-ray generator located in a shielded enclosure of a station for inspecting products such as food or beverages in containers moving through the station on a conveyor. Deployed in a sliding attachment on a collimator housing of the x-ray generator, a shutter plate is made movable by an actuator and is configured with an aperture that, in the absence of power applied to the actuator, is made to align with a fixed aperture of the collimator so as to allow emission of the x-ray beam as required for normal inspection purposes. Whenever an anomaly in the product loading on the conveyer creates a gap at the entry and exit openings in the shielded inspection enclosure that could otherwise cause an increase in environmental radiation levels, powering the actuator moves the shutter plate to an offset location that offsets the apertures to an effectively closed state to initiate a standby condition wherein x-ray radiation is substantially confined to the interior region of the collimator, without having to shut down the x-ray generator itself.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
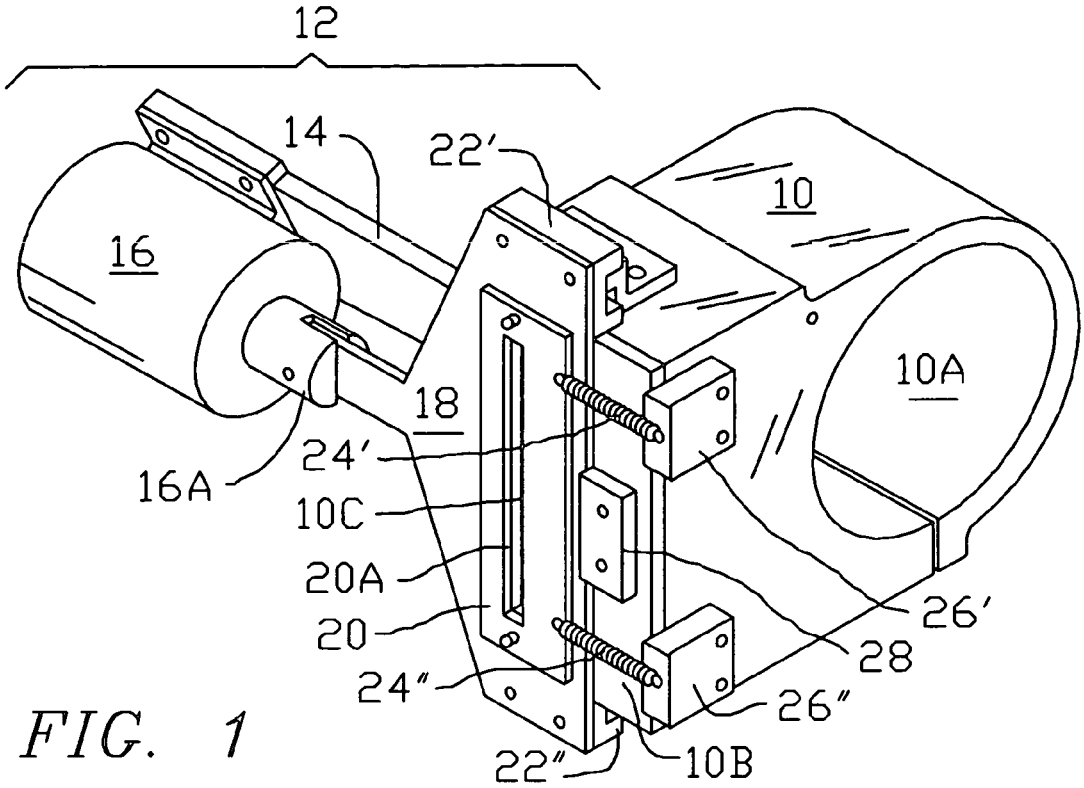
FIG. 1 is a three-dimensional view of an x-ray collimator fitted with a shield-shutter assembly of the present invention, shown in an open-aperture normal operating condition.

FIG. 1 depicts an X-ray collimator 10 configured with a cylindrical opening 10A within a clamping structure for engaging an X-ray tube in a conventional manner. Collimator 10, which may be a pre-existing or custom type, is fitted with a shield-shutter assembly 12 of the present invention in an illustrative embodiment.

A front plate 10B is bolted or otherwise firmly attached to the front face of the collimator 10. Attached to the far side of collimator 10 and seen extending to the left is a support bracket 14 which supports a solenoid 16, attached as shown. Plunger 16A of solenoid 16 is coupled to a yoke plate 18 on which is attached a shutter plate 20 configured with an elongate vertical shutter aperture 20A as shown. The front plate 10B, yoke plate 18 and shutter plate 20 are made from materials having lead content and thus high molecular weight for effective x-ray shielding, e.g. brass, moderately leaded steel and highly leaded steel, respectively.

Yoke plate 18 is captivated in a sliding manner to the collimator 10 by a pair of ball-bearing slide sets 22 and 22" at the top and bottom respectively.

A pair of coil springs 24' and 24" are attached at their left hand ends to yoke plate 18 and at their right hand ends to the collimator 10 via a pair of spring attachment blocks 26' and 26" attached to collimator 10 so as to extend slightly beyond its right front corner.

In the preferred embodiment, the condition depicted in FIG. 1 is the default condition in which solenoid 16 is not energized. Tension in coil springs 24' and 24" holds the yoke plate 18 constrained against a stop block 28 which is attached to front plate 10B, thus the shutter assembly, including plunger 16A, yoke plate 18 and aperture plate 20, is held at the right hand end of its travel range as shown. A fixed aperture 10C similar in size and shape to the shutter aperture 20A is configured in front plate 10B and is located such that in this default state the two apertures are aligned to make this the open-shutter condition that allows the x-ray beam to exit and perform the desired inspection function.

Figure 2:
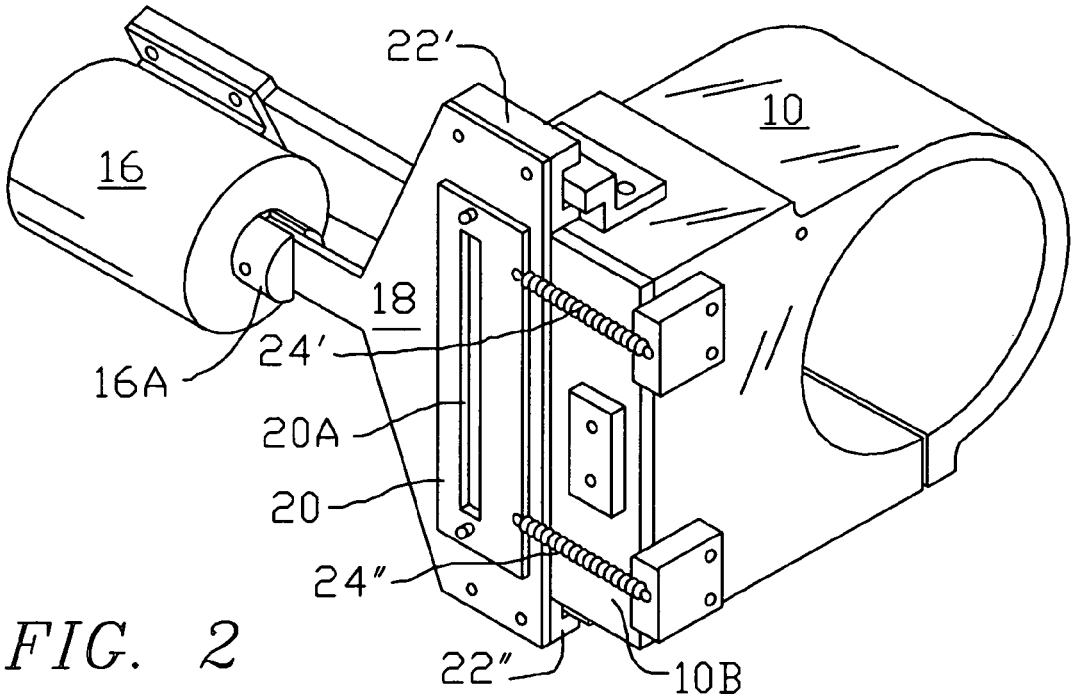
FIG. 2 shows the shuttered collimator of FIG. 1 with the shield-shutter having been actuated to invoke the closed-aperture standby condition.

FIG. 2 depicts the items of FIG. 1, in the alternate closed-shutter condition with solenoid 16 having been powered so as to move plunger 16A and the shutter assembly including yoke plate 18 and aperture plate 20 to the left hand end of the travel range against the spring tension of coil springs 24' and 24' which have become extended as shown. The movement to the left is in a horizontal direction constrained to a linear path by the ball bearing slide assemblies 22' and 22". Due to the displacement of aperture 20A to the left, it is no longer aligned with the fixed aperture (10C, FIG. 1) in front plate 10B, thus the shutter is closed and the x-ray radiation is substantially restricted to the interior of collimator 10.

The type of control system selected for actuating solenoid 16 depends on particular situation requirements and conditions, and could range from simple on-off control by a human operator to automatic operation in response to signal from sensors arranged to detect the loading of a conveyor and to thus invoke the closed-shutter condition whenever a void, stoppage or other anomalous condition is detected in the product load that might otherwise result in increased x-ray radiation exposure.

While in the preferred embodiment, solenoid 16 is implemented as an electrically-powered electro-magnetic solenoid, typically controlled via an electrical relay as part of control system, its function to move the shutter assembly between its two states, open and closed, could alternatively be provided in some other equivalent form such as a pneumatic or hydraulic actuator, with suitable control apparatus. Other forms of energy transducers and couplings such as linear motors, gears and pinions could be utilized to actuate the shutter assembly.

As an alternative to the above described embodiment wherein the default condition is made to be the open-shutter condition, the default condition could be made to be the closed-shutter condition by locating the fixed aperture to align with the shutter aperture 20A when the solenoid is not powered (as in FIG. 1). The choice between these two possible locations of the fixed aperture is a matter of design choice with tradeoffs relating to energy-efficiency, depending on the overall duty cycle with which the x-ray is being operated, and considerations in the event of failure of the solenoid or its power source. The choice made for the preferred embodiment was based on the advantages that, under anticipated conditions of near 100% overall duty cycle, the absence of holding power in the solenoid represents an energy saving, and in the event of failure of the solenoid or its power source fail, production could continue without interruption pending corrective action.

As an alternative to the spring-loaded system that requires continuous holding power at one of the shutter travel range, it is mechanically possible to utilize a toggled system that requires power only during the period of transition between the two states, i.e. moving the shutter aperture in or out of alignment with the fixed aperture.

As an alternative to the linear travel system disclosed, the principle of the invention could be practiced with equivalent alternative mechanical arrangements to move the shutter plate in the desired manner to place the two; for example the shutter plate movement could be rotational to implement the two states.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A shutter-shield system, for reducing potential human risk of cumulative effects from extraneous x-radiation, applied to a collimator including a collimator housing configured with a fixed working aperture and deployed in conjunction with an x-ray tube for a designated inspection purpose conducted totally within an overall shield housing, comprising;

a shutter-shield plate configured with a shutter aperture made generally similar to the fixed working aperture in size and shape;

a shutter support structure made and arranged to retain said shield shutter plate constrained with ability to shift within a predetermined travel range between (1) an open-shutter condition wherein the shutter aperture is aligned with the fixed working aperture so as to allow x-radiation through a thus combined aperture for the designated inspection purpose and (2) a closed-shutter condition for standby purposes wherein offset displacement of the shutter-shield plate causes the shutter aperture to be similarly displaced offset from the fixed working aperture so as to in effect close the combined aperture and thus substantially contain x-ray radiation within a region of the collimator housing bounded by the shutter-shield plate; and a drive mechanism attached to the collimator and operationally connected to said shutter-shield plate, made and arranged to actuate transition between the two shutter conditions in response to a control signal, said drive mechanism comprising:

an electrical solenoid, having a plunger operationally connected to said shutter-shield plate; and spring biasing means, operationally connected to said shutter-shield plate, made and arranged to urge said shutter-shield plate to move to a first end of the travel range whenever said electrical solenoid is not powered, said electrical solenoid being made and arranged to urge said shutter-shield plate to move to a second end of the travel range, opposite the first end, whenever said electrical solenoid is powered.

2. The shutter-shield system as defined in claim 1 wherein said shutter-shield plate is configured with the shutter aperture located in a manner to deploy the open-shutter condition at the first end of the travel range, i.e. whenever the solenoid is not powered, and to deploy the closed-shutter condition at the second end of the travel range, i.e. whenever the solenoid is powered.

3. The shutter-shield system as defined in claim 1 wherein said spring biasing means comprises at least one coil spring having a first end attached to said shutter-shield plate and having a second end, opposite the first end, attached to the collimator housing.

4. The shutter-shield system as defined in claim 1 further comprising:

a pair of ball-bearing slide assemblies, each having a first member attached to said shutter-shield plate and a second member attached to the collimator housing, made and arranged to provide said shutter-shield plate with freedom of movement, but only in a predetermined linear direction and within the predetermined travel range.

* * * * *